US005388831A

United States Patent [19]

Quadri et al.

[11] Patent Number: 5,388,831

[45] Date of Patent: Feb. 14, 1995

[54] LUMINOUS GOLF PRACTICE DEVICE

[76] Inventors: Michel Quadri, 9 Ch. Val-de-Travers, 1290 Versoix; Francois Wahl, Les Pessules 2, 1296 Copper, both of Switzerland

[21] Appl. No.: 122,477

[22] PCT Filed: Jan. 28, 1994

[86] PCT No.: PCTCH/93/00021

§ 371 Date: Sep. 27, 1993

§ 102(e) Date: Sep. 27, 1993

[87] PCT Pub. No.: WO93/14830

PCT Pub. Date: Aug. 5, 1993

[30] Foreign Application Priority Data

Jan. 28, 1993 [FR] France ..... 92 01056

[51] Int. Cl.[6] ..... A63B 69/36

[52] U.S. Cl. ..... 273/186.3

[58] Field of Search ..... 273/186.3, 194 R, 186.2, 273/187.4, 194 A, 183.1; 434/252

[56] References Cited

U.S. PATENT DOCUMENTS 3,953,034 4/1976 Nelson .
4,971,327 11/1990 Rabold .
5,029,868 7/1991 Cloud .
5,165,691 11/1992 Cook ..... 273/186.3
5,193,812 3/1993 Hendricksen ..... 273/186.3
5,207,429 5/1993 Walmsley et al. ..... 273/186.3
5,213,331 5/1993 Avanzini ..... 273/186.3

FOREIGN PATENT DOCUMENTS 0499569 8/1992 European Pat. Off. .

OTHER PUBLICATIONS

Patent Abstracts of Japan vol. 900, No. 409 (C-0707) 1990 & JP, A, 20 23 974 (Shomonoto Kenkichi).

*Primary Examiner*—Jessica J. Harrison
*Attorney, Agent, or Firm*—David, Bujold & Streck

[57] ABSTRACT

A device designed to be fitted to or built into a golf club such as a putter to assist in learning the correct club position, in particular for indoor or home putting practice. A transmitter unit is releasably attached to the shaft of the club and comprises a laser diode for transmitting a parallel light beam towards an optical unit having a cylindrical lens above the club iron. The lens diffuses the light along a vertical plane to form a beam directed at the ground in front of the iron, whereby the player is able to see a line of light on the ball and on the ground indicating the direction in which the ball will travel depending on the position of the striking surface of the iron. In one embodiment, the optical system may be supported by an arm attached to the shaft.

10 Claims, 2 Drawing Sheets

LUMINOUS GOLF PRACTICE DEVICE

The object of the present invention is an auxiliary luminous device for golf practice, especially for practicing strokes or putting, consisting of a light source and an optical unit designed to diffuse a light beam onto a plane, said transmitter and said optical unit being attached to a golf club in such a way that the plane over which the light is diffused is perpendicular to a striking surface on the club and forms a line of light on the ground.

BACKGROUND OF THE INVENTION

Given the increasing popularity of golf and the lack of available courses, golfers tend to practice with specialized equipment which can be used in a yard or other available space. Various types of simulators have been proposed for the purpose of swing practice, that is, forcefully hitting the ball forward. However, rolling the ball or putting practice require only a flat surface covered with suitable carpeting and with a hole or substitute goal. In putting the ball is hit with a club called a putter, with a relatively broad iron whose striking surface is nearly vertical when contacting the ball. The main difficulty in putting is to orient the striking surface of the iron along a plane which is perpendicular to the vertical plane passing through the center of the ball and the through center of the hole. In reality, a golfer can only acquire the habit of orienting the club correctly after numerous repetitive practice strokes, since the direction which the ball takes supplies the only indication of whether the iron position was correct.

Putting practice devices are already known and consist of one or two luminous diodes on the putter head, each emitting a linear beam in a direction perpendicular to the striking surface, thereby allowing the golfer to stop the club in the ideal position. However, such a device is of little use when the club moves, as the line of each light beam on the ground is a point which moves too quickly to be of any use to the player in correcting his or her motions.

U.S. Pat. No. 3,953,034 concern an auxiliary device mounted on a golf club for swing practice. A linear laser light beam emitted by a light source attached to the handle strikes a convex mirror attached below the handle near the striking surface. The laser beam is reflected forward in the form of a planar vertical beam perpendicular to the striking surface, creating a line of light on the ground which predicts the direction parallel to the probable trajectory of the ball. In actuality, such a device allows one to verify only the horizontal orientation of the striking surface and no other parameters relating to its position, notably the possibility that it will diverge laterally from the ball. Furthermore, it is not useful for putting practice when the ball is fairly close to the hole, since the light beam it creates would pass beside the hole and would not give the golfer a clear, precise indication.

SUMMARY OF THE INVENTION

The object of the present invention is to improve devices such as those described above and make them useful for putting practice by allowing the user to visualize the ideal club position more clearly at the moment the club strikes the ball.

To accomplish, the device of the invention is characterized in that the plane over which the light beam is diffused passes through one point where the ball impacts the striking surface, and in that the optical unit is located behind a plane defined by the striking surface.

This arrangement allows the golfer to place the putter exactly across from the ball and at the same time, to orient it correctly, thanks to the line which the light beam traces simultaneously upon the ball and on the ground. Furthermore, all these indications are present both when the club is stationary and when it is moving. The optical unit may advantageously be located higher than the striking surface, so that one part of the diffused beam always passes above the ball.

The light beam is preferably a beam parallel to the output of the transmitter, which may be a laser transmitter, and the optical unit comprises a cylindrical lens. The device may have a source of electrical energy supplying the transmitter and attached to the golf club.

In one particular embodiment, the optical unit is built into the transmitter which is attached to an adjustable arm that can be detached from the shaft of the golf club.

In another embodiment, the optical unit has a reflector which is integral with the cylindrical lens and is situated at some distance from the transmitter. In this case the transmitter may be located on the club shaft or it may be incorporated into the shaft.

BRIEF DESCRIPTION OF THE DRAWINGS

The present invention and its advantages will be more apparent from the following-description of two embodiments, with reference to the attached drawings, wherein.

DESCRIPTION OF THE PREFERRED EMBODIMENTS

Figure 1:
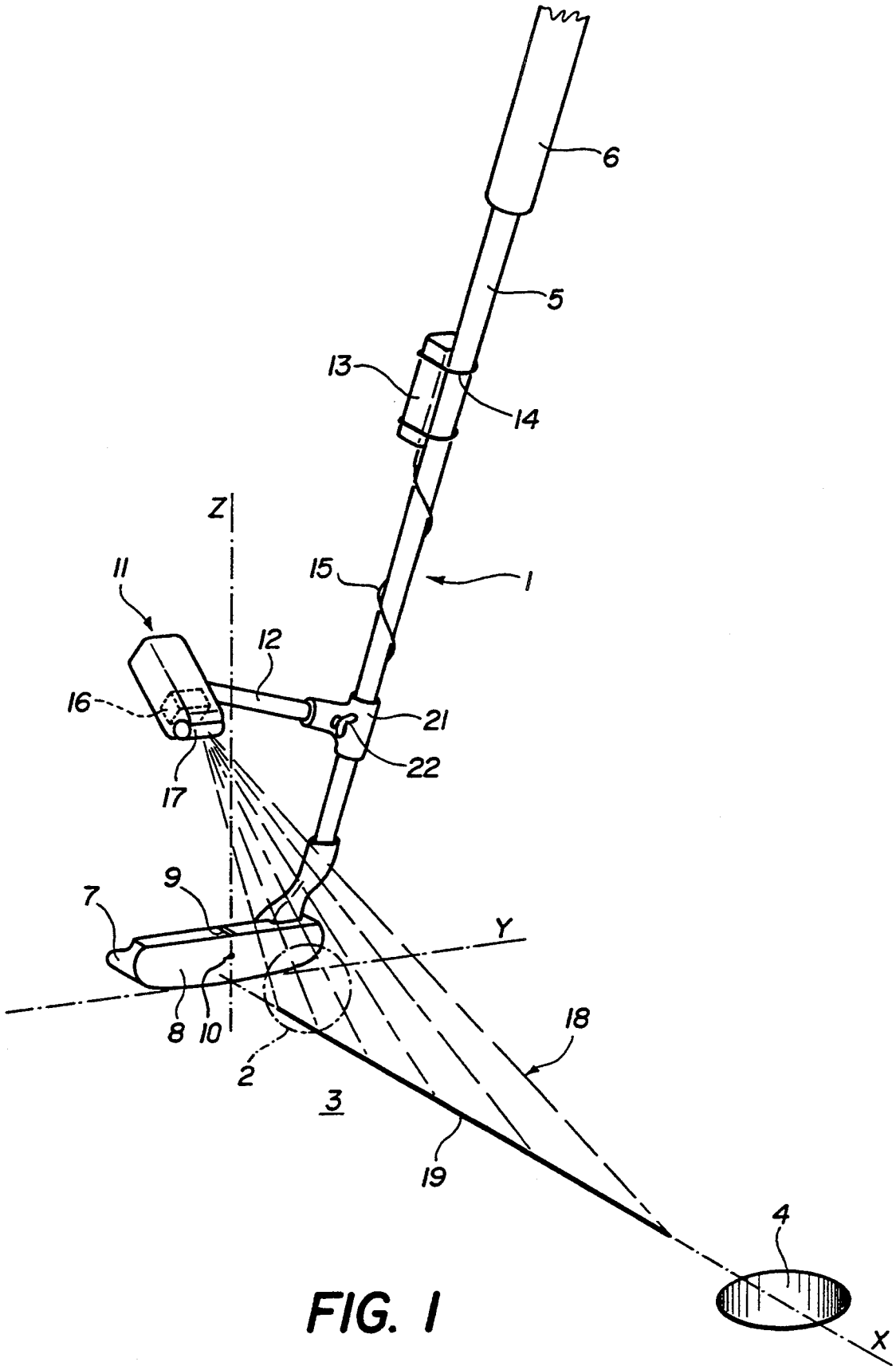
FIG. 1 is a perspective of a golf putting club equipped with a device which is the first embodiment of the invention.

FIG. 1 shows a "putter" golf club 1 for hitting a golf ball 2 and making it roll across the ground 3 to a hole 4. In known manner, the club 1 comprises a shaft 5 with a grip 8 and is attached, at its lower extremity, to a specially designed club 7 which has a generally flat striking surface 8 opposite ball 2, and which is normally vertical when it strikes the ball if the golfer is holding the club properly. An index mark 9 is notched into the club 7 to indicate the center of the striking surface 8, that is, the ideal point of impact 10 between surface 8 and ball 2.

In FIG. 1 striking surface 8 is vertical; it is represented by path Y on the ground and by vertical axis Z passing through point 10. A third axis X orthogonal to axes Y and Z represents the normal straight line on surface 8 at the point of intersection of axes Y and Z. In the ideal position shown here, axis X follows the ground 8, then surface 8 is vertical, and plane XZ passes through the center of ball 2 and through the center of hole 4 since that is the direction in which one wishes to roll ball 2.

The device according to the invention is detachable from club 1. It consists of an electronic optical unit 11, a support 12 which can be detached from shaft 5 and which maintains the adjustable position of unit 11, a source unit 13 attached to shaft 5 with straps 14, and a pair of electrical conductors 15 connecting units 11 and 13. Unit 11 contains a coherent red light beam transmitter consisting of a laser diode 16 emitting in a band of 670 nm. Unit 11 also contains the electronic circuitry controlling the diode functions.. Laser diode 16 emits a parallel light beam which strikes a cylindrical lens 17 with an axis parallel to axis Y, i.e., the lens disperses the parallel light beam into a divergent planar beam 18 onto a vertical plane parallel to plane XZ. In effect, because of adjustable support 12, unit 11 is designed so that beam 18 is located precisely in plane XZ and is directed downward and in front of club 7. As a result, beam 18 will form a rectilinear line 19 on the ground 3 which, in the position shown, coincides with axis X. Generally speaking, line led represents the intersection of vertical plane XZ with the ground 3 and thus shows the golfer the theoretical trajectory of ball 2 as a function of the orientation of striking surface 8 if the ground is perfectly horizontal.

Note that support 12 is attached to shaft 5 by a clip 21 with a wing nut 22 or with a pressure or socket device so it can easily be affixed in the desired position on any type of golf club. This allows the same device to be used with various types of clubs. Furthermore, the level of support 12 along sleeve 5 can be changed at will, for example in order to modify the angle or the range of light beam 18. Source unit 13 might also be incorporated within unit 11 or attached to support 12.

Figure 2:
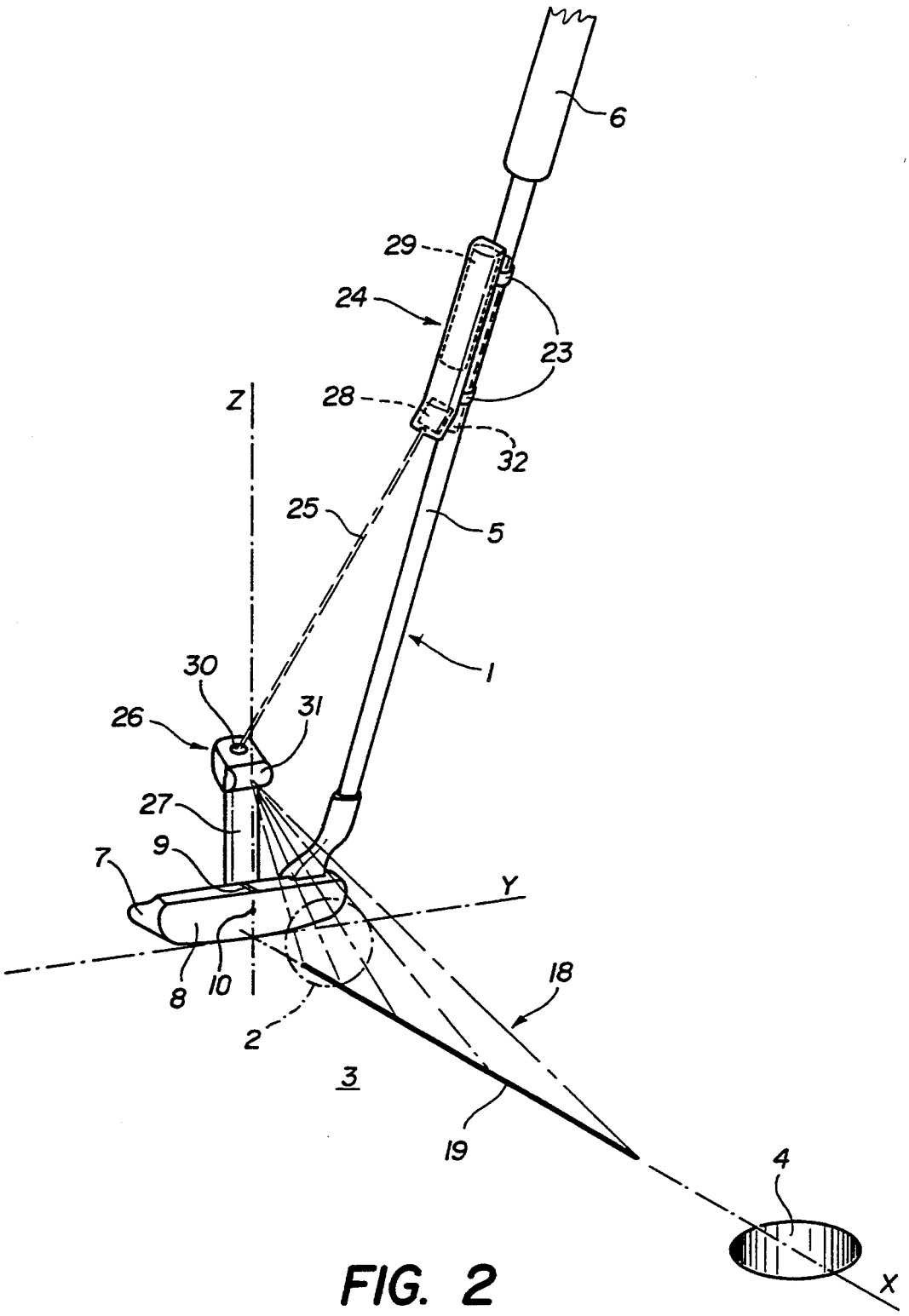
FIG. 2 is a view analogous to FIG. 1 of a second embodiment of the invention.

In the embodiment shown in FIG. 2 the device comprises a light transmitting unit 24 which is attached to shaft 5 of club 1 with straps 23 and emits a coherent, parallel light beam 25 toward an optical unit 28 held by support 27 attached to club 7. The transmitter 24 contains a laser diode 28, an energy source such as a battery 29 and electronic circuitry controlling the laser diode. Optical unit 28 is in the form of a small case with a window 30 at the top, having a cylindrical lens 31 and an internal reflector (not shown) designed to reflect the parallel light beam 25 on plane XZ toward cylindrical lens 30. The latter is arranged in the same way as in the preceding example and forms the divergent light beam 18 so it is directed downward on vertical plane XZ. The advantage of this design over that of the preceding example is that it concentrates the majority of the weight of the device in the shaft. The angle of parallel beam. 25 in relation to shaft 5 can remain constant. Beam 25 can be centered in window 30 by adjusting the position of unit 24 on the handle.

The preceding description demonstrates how the device of the invention shows the golfer in advance the initial trajectory of the ball within the line of light 19 and quickly teaches the golfer proper club position and position of the hands on the putter grip. In addition, the designs described allow for optical units 11 and 28 to be positioned entirely behind plane YZ of striking surface 8 so they do not interfere at any time with the user's view of surface 8, ball 2 or index 9. A club equipped with this device can be used for putting practice on any surface, particularly on an artificial carpeted surface, thereby allowing a golfer to practice at home or at an indoor sports facility.

The scope of the present invention is not limited to the embodiments described above, but extends to any modification or variation obvious to one skilled in the art. In particular, it is possible to create a putter which completely integrates the device of the invention, specifically with club 7 and shaft 5 or grip 6. In FIG. 2, for example, reference numeral 32 indicates one possible location of the light beam transmitter and the electric battery inside the handle. Or a putter might be pre-equipped with a support to which the light device could be attached, allowing the club to be used for both practice and actual play, indoors or out. Furthermore, the light beam may be supplied by various types of transmitters so long as it can be collimated ,onto a plane and its color is visible on the ground.

We claim:

1. An auxiliary luminous device, for assisting a user with golfing practice, comprising a light beam transmitter and an optical unit arranged to diffuse a generated light beam in a plane;

the device being used in combination with a golf club having a striking surface;

the transmitter and the optical unit being attached to the golf club;

the optical unit being aligned relative to the golf club so that the plane in which the light beam is to be diffused extends perpendicular to the striking surface of the golf club and passes through a point of impact between a golf ball, to be struck by the golf club, and the striking surface, and the light beam, when diffused, forms a line of light on the ground during a golfing stroke; and the optical unit being located behind a plane defined by the striking surface.

2. The combination according to claim 1 wherein the optical unit is attached to the golf club remote from the striking surface.

3. The combination according to claim 1 wherein the light beam transmitter is a laser transmitter emitting a parallel light beam.

4. The combination according to claim 1 wherein the optical unit has a cylindrical lens for diffusing the generated light beam.

5. The combination according to claim 4 wherein the optical unit comprises a reflector attached to the cylindrical lens and spaced from the transmitter.

6. The combination according to claim 5 wherein the transmitter is secured to the shaft of the golf club.

7. The combination according to claim 5 wherein the transmitter is incorporated within the golf club shaft.

8. The combination according to claim 1 wherein the device further comprises an electrical energy source to supply the light beam transmitter with electrical power; and the electrical energy source is attached to the golf club.

9. The combination according to claim 1 wherein the optical unit and the transmitter are included in an electronic and optical unit; and the electronic and optical unit is attached to an adjustable arm releasably mounted to a shaft of the golf club.

10. A method of using an auxiliary luminous device, comprising a light beam transmitter and an optical unit arranged to diffuse a generated light beam in a plane, to assist a user with golfing practice, the method comprising the steps of:

using the device in combination with a golf club having a striking surface;

attaching the transmitter and the optical unit to the golf club;

aligning the optical unit relative to the golf club so that the plane in which the generated light beam is to be diffused extends perpendicular to the striking surface of the golf club and forms a line of light on the ground during a golfing stroke; and locating the optical unit behind a plane defined by the striking surface so that the plane in which the generated light beam is diffused passes through a point of impact between a golf ball, to be struck by the golf club, and the striking surface.

* * * * *

UNITED STATES PATENT AND TRADEMARK OFFICE

CERTIFICATE OF CORRECTION

PATENT NO. : 5,388,831

DATED : February 14, 1995

INVENTOR(S) : Michel QUADRI and Francois WAHL

It is certified that error appears in the above-identified patent and that said Letters Patent is hereby corrected as shown below:

On title page, item [22] replace "PCT Filed: Jan. 28, 1994" with --PCT Filed: Jan. 28, 1993--.

Title page, item [30] replace "Jan. 28, 1993" with --Jan. 28, 1992--.

Signed and Sealed this

Twenty-fifth Day of April, 1995

*Attest:*

*Attesting Officer*

BRUCE LEHMAN

*Commissioner of Patents and Trademarks*